United States Patent [19]

Unkuri et al.

[11] Patent Number: 5,007,623

[45] Date of Patent: Apr. 16, 1991

[54] METHOD FOR FEEDING THE PRIMARY WEB OF A MINERAL WOOL WEB BY MEANS OF A PENDULUM CONVEYOR ONTO A RECEIVING CONVEYOR AND AN ARRANGEMENT OF SUCH A PENDULUM CONVEYOR

[75] Inventors: Matti Unkuri; Tom Nurmi, both of Pargas, Finland

[73] Assignee: Oy Partek AB, Pargas, Finland

[21] Appl. No.: 354,433

[22] PCT Filed: Nov. 11, 1987

[86] PCT No.: PCT/FI87/00151

§ 371 Date: May 8, 1989

§ 102(e) Date: May 8, 1989

[87] PCT Pub. No.: WO88/03509

PCT Pub. Date: May 19, 1988

[30] Foreign Application Priority Data

Nov. 12, 1986 [FI] Finland ..... 864613

[51] Int. Cl.[5] ..... B65H 45/10

[52] U.S. Cl. ..... 270/39; 270/30; 19/163; 493/411; 493/415

[58] Field of Search ..... 270/30, 31, 39; 19/161, 19/163, 144; 493/409–412, 413–417

[56] References Cited

U.S. PATENT DOCUMENTS 2,710,992 6/1955 Goldman .
2,962,772 12/1960 Draving ..... 19/163

FOREIGN PATENT DOCUMENTS 43451 9/1985 Japan ..... 19/163
143444 12/1953 Sweden ..... 19/163
452040 1/1986 Sweden .
1030805 5/1966 United Kingdom ..... 19/163

*Primary Examiner*—John T. Kwon
*Assistant Examiner*—Therese M. Newholm
*Attorney, Agent, or Firm*—Cushman, Darby & Cushman

[57] ABSTRACT

In a method for feeding out the primary web of a mineral wool web by means of a pendulum conveyor and to an arrangement of such a pendulum conveyor, an output is fed as close to the receiving conveyor as possible for the primary web to be rapidly fixed onto the underlying web. The conducting rollers at the output end, which rotate in the output direction, have a disturbing effect on such a close output. The front conducting roller in the direction of motion rotates in a direction having a lifting effect on the underlying web, which is negative, whereas the rear conducting roller rotates in a direction pressing down the web being fed out, which is advantageous for the output. Both conveyors of the pendulum conveyor are made vertically movable with regard to each other, the front conducting roller being situated higher and the rear conducting roller lower during the pendulum swing. The reversing mainly takes place in the end position of the pendulum swing. The reversing may take place momentarily or gradually during the entire pendulum motion.

8 Claims, 2 Drawing Sheets

METHOD FOR FEEDING THE PRIMARY WEB OF A MINERAL WOOL WEB BY MEANS OF A PENDULUM CONVEYOR ONTO A RECEIVING CONVEYOR AND AN ARRANGEMENT OF SUCH A PENDULUM CONVEYOR

A method for feeding the primary web of a mineral wool web by means of a pendulum conveyor onto a receiving conveyor and an arrangement of such a pendulum conveyor.

BACKGROUND OF THE INVENTION

The present invention relates to a method for feeding out the primary web of a mineral wool web by means of a pendulum conveyor and to an arrangement of such a pendulum conveyor.

When making mineral wool webs by using a pendulum conveyor for the output, the aim is to achieve a thin primary web, yielding a homogeneous end product. The primary web being thin, the output speed has to be high, 200 m/min or more, in order to obtain the desired capacity.

A thin primary web of mineral wool is very plastic, and to prevent its hovering out of control during output at a high rate, thus causing uneven edges, one tries to carry out the output as close to the receiving conveyor as possible, at least over a major part of its width. Thus, each layer of the primary web is allowed to lay down and adhere to the preceding layer before feeding the following layer on top. A problem always arising in this situation is that of the pendulum tending to sweep back the previously fed layer of the primary web during the reverse motion. This problem is increased by the fact that the end rollers, the conducting rollers of the pendulum conveyors, always rotate outwards for outputting the primary web. This means that the conducting roller preceding in the direction of motion rotates in the same direction as the pendulum motion, tending to lift the layer fed out during the previous pendulum swing, thus hampering the forming of even edges and a flat layer. The second conducting roller, i.e. the subsequent one in the direction of motion, rotates in a direction opposite to the pendulum motion, having however the same direction of rotation as the output motion of the primary web and tending to advance the depositing of the layer being fed out.

SUMMARY OF THE INVENTION

The purpose of the present invention is to reduce the negative consequences and to increase the positive consequences of the effect of conducting rollers on the fixing of the fed out layer to the underlying layer.

The pendulum conveyor has been made movable in a shears-like manner, the facing conveyors being displaced vertically with regard to each other for each pendulum swing, so that the pendulum conveyor preceding in the direction of motion is situated higher than the subsequent pendulum conveyor. Thus, the lower conducting roller of the preceding pendulum conveyor is situated further away from the receiving conveyor than the conducting roller of the subsequent pendulum conveyor. By this arrangement, the conducting roller rotating in the same direction as the pendulum and having tended to lift the layer fed out during the previous pendulum swing, is separated from the receiving conveyor and does not influence the underlying layer as easily. At the same time, the second, subsequent conducting roller, towards which the output of the primary web is directed, and which has the same direction of motion as the primary web, is situated closer to the receiving conveyor and advances the pressing and fixing of the web onto the receiving conveyor.

In this manner, a more rapid fixing of the fed out layers is achieved, and consequently also a better controlled loop or edge forming.

The reversing of the mutual height position of the pendulum conveyors preferably is synchronous with the pendulum motion, taking place when the conveyor is in either of the end positions.

The reversing is preferably done mechanically by connecting to the connecting rod that drives the pendulum conveyor. The reversing may also be hydraulically or pneumatically performed under the effect of an impulse from e.g. a limit switch valve.

The pendulum conveyors are preferably connected to each other and to a reversing mechanism which in the end positions of the pendulum motion, actuates the reversing of the height position of the two pendulum conveyors with regard to each other. The reversing mechanism may be a hydraulic or pneumatic cylinder which by an impulse actuates the connection of the pendulum conveyor. The conveyors are preferably interconnected by a mechanical arm system forming a parallelogram together with the conveyors. The parallelogram may be connected to the connecting rod driving the pendulum conveyor. In this case, the reversing is continuous during the entire pendulum swing and reaches its maximum at the midpoint of the pendulum. In the end positions both pendulums are essentially at the same height.

BRIEF DESCRIPTION OF THE DRAWINGS

The invention is described below with reference to the attached drawing figures illustrating two preferred embodiments of the arrangement according to the invention and in which.

Corresponding parts have been marked with the same reference numerals in the figures.

DETAILED DESCRIPTION

Figure 1:
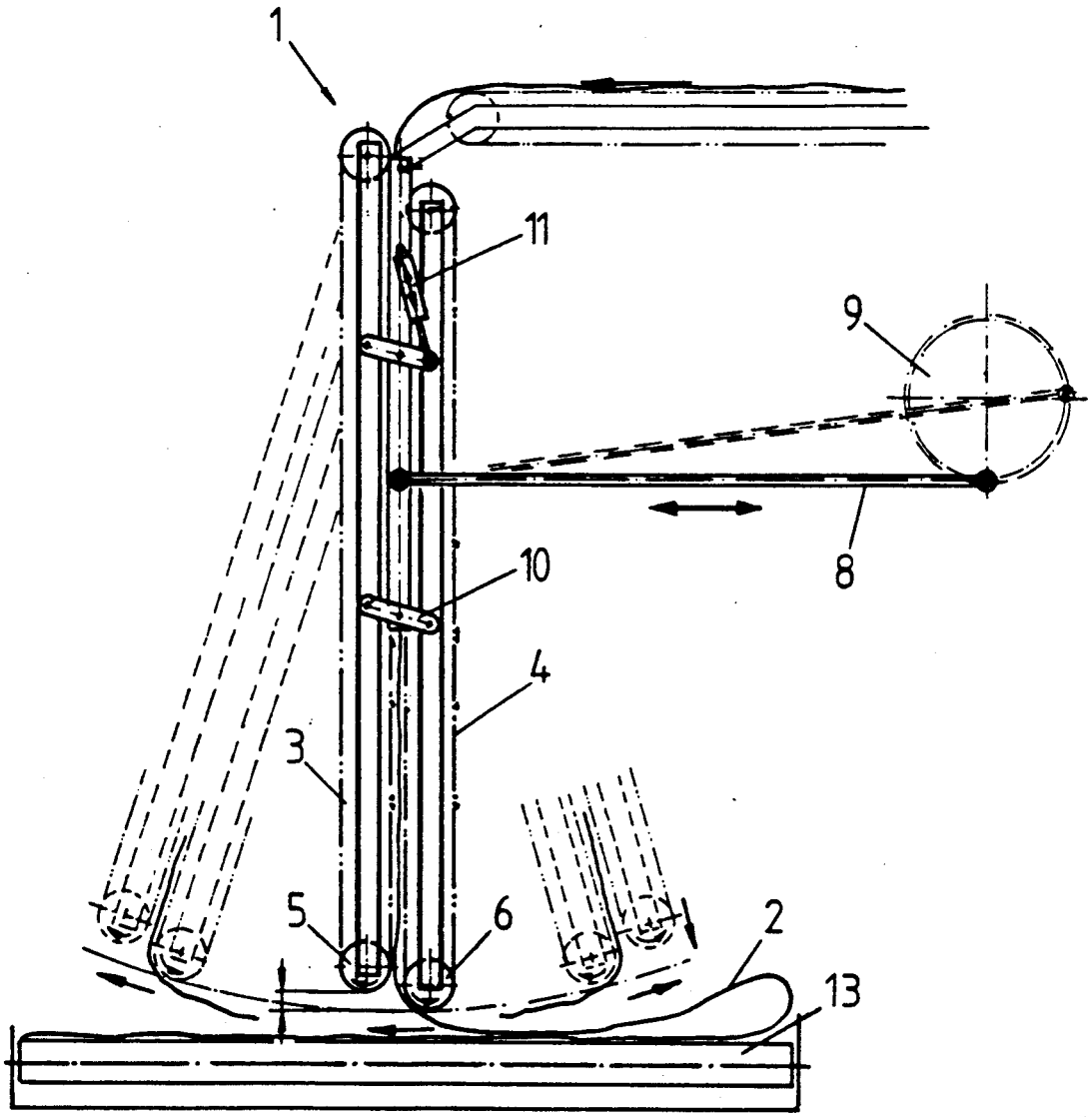
FIG. 1 is a side elevation view of an arrangement according to the invention, the pendulum conveyor being at the midpoint, two side positions being indicated with dotted lines.

The pendulum conveyor has been generally designated by the numeral 1, the primary web with 2, the left-hand conveyor with 3 and the right-hand conveyor with 4, the lower left-hand conducting roller with 5 and the lower right-hand conducting roller with 6, the receiving conveyor with 7, the driving connecting rod with 8 and its driving wheels with 9, the arms joining the two conveyors of the pendulum conveyor with 10. In FIG. 1, the hydraulic or pneumatic cylinder carrying out the reversal is designated 11 and, in FIG. 2, the arm carrying out the reversal is designated 12. The receiving conveyor is designated 13.

In FIG. 1, the primary web 2 is fed out from a horizontal conveyor into the gap between the two conveyors 3 and 4 of the pendulum conveyor. The conveyors 3 and 4 are driven by the rollers at the ends of the conveyors, the lower rollers, i.e. the so-called conducting rollers are designated 5 and 6. In the figure, the pendulum conveyor 1 (as shown in lines) moves to the left (as shown in one set of dashed lines) and consequently the left-hand conveyor 3 with its conducting roller 5 is in a raised position. At the output end, the primary web follows the right-hand conducting roller 6 and is deposited, owing to the position of this, close to the receiving conveyor. Simultaneously, the rotation of the conducting roller 6 in the same direction as the output of the primary web advances the pressing and fixing of the primary web onto the underlying layer. When the pendulum conveyor reaches the left-hand end position, the cylinder 11 is actuated to influence the height position of the conveyors 3 and 4 with regard to each other. One end of the cylinder 10 is connected to a stand for the pendulum conveyor and the other end is connected to the upper one of two arms 10 joining the conveyors like a parallelogram. At the end position of the pendulum swing a valve is influenced, not shown in the figure, whereby the cylinder is actuated to pull the upper arm 10 upwards, whereby the conveyor 4 rises , while the conveyor 3 sinks. In the right-hand end position of the pendulum conveyor, the opposite movement takes place, whereby the right-hand conveyor sinks and the left-hand conveyor rises. The figure illustrates how the primary web is fed out under control onto the receiving conveyor 13 and how it is fixed onto the underlying layer.

Figure 2:
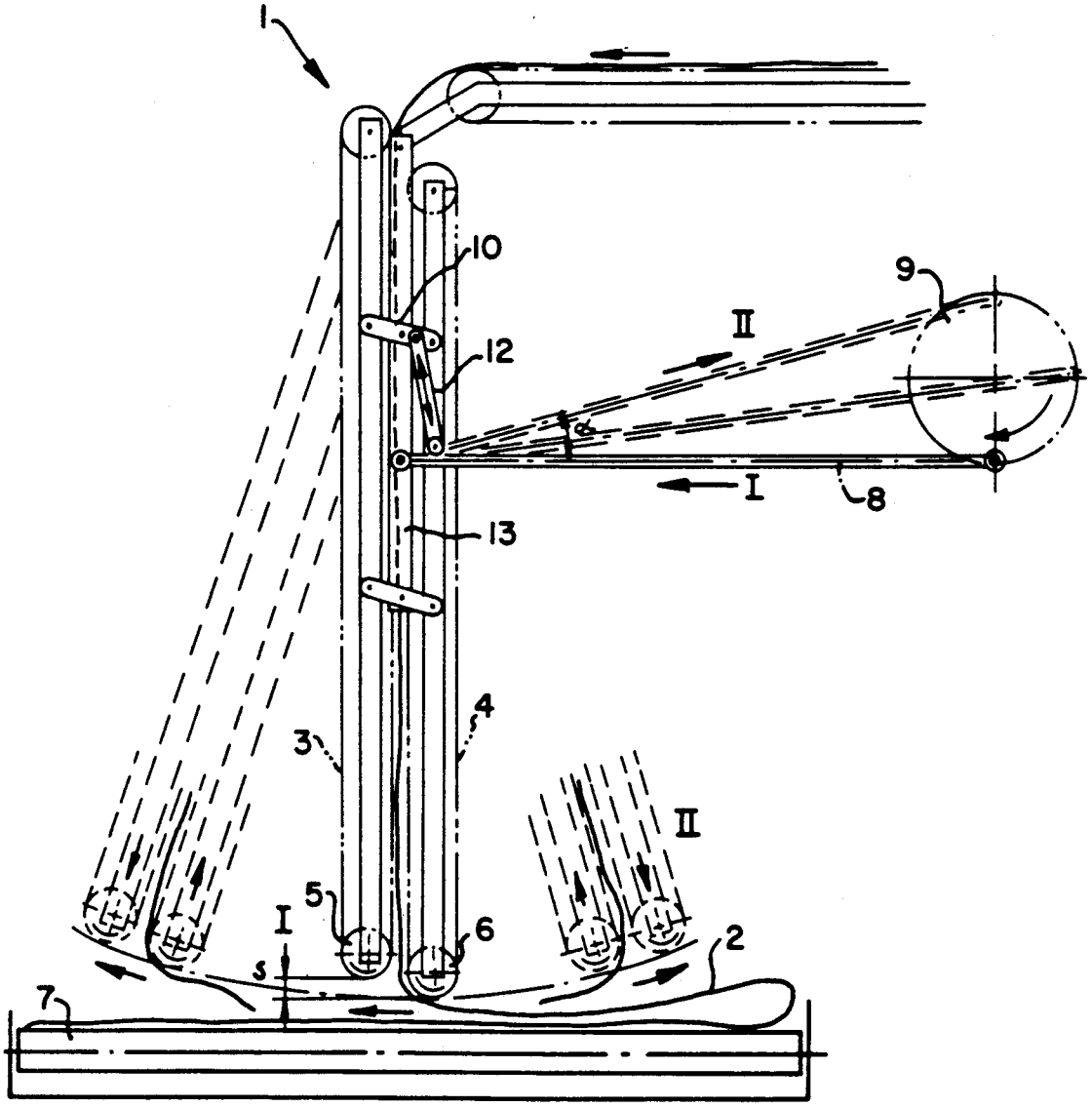
FIG. 2 shows a modification of the arrangement according to FIG. 1, but illustrated in the same manner.

FIG. 2 illustrates the same arrangement as in FIG. 1, however with the difference that the conveyors, which are joined by the arms 10, are connected to the driving connecting rod 8 through an arm 10, of which one end is connected to the upper arm 10 and the other end is connected to the connecting rod. The rising and sinking of the connecting rod is transmitted through the arm 12 to the conveyor parallelogram. During the clockwise rotation of the driving wheel and the displacement of the pendulum conveyor from the extreme right-hand position II towards the central position I, the left-hand conveyor is continuously lifted and reaches maximal height in the central position. During the continued motion towards the left-hand extreme position the arm 10 gradually lifts the right-hand conveyor upwards and lowers the left-hand conveyor equally. In the left-hand extreme position as in the right-hand extreme position the conveyors will thus be at approximately the same height. The maximal difference of height s is always reached in the central position. Thus the purpose of the invention is achieved, i.e. that the conducting roller pressing downwards is closest to the receiving conveyor and that the lifting conducting roller is at the maximal distance from this at the pendulum stage at which the pendulum conveyor moves closest to the receiving conveyor. Due to the fact that the output end in the extreme positions and in the vicinity of these are further away from the receiving conveyor, the mutual height position of the conducting rollers do not have the same importance for the fixing of the primary web onto the support.

In this embodiment, the conveyors are continuously displaced with regard to each other, however the real reversing of the mutual height position of the conveyors takes place in the end positions. On the contrary, in the preceding embodiment, the reversing takes momentarily place in the end positions, whereby the height position is kept unchanged during the entire pendulum swing.

With reference to the above facts it is conceivable to carry out the reversing somewhat before the end position or somewhat after the end position in the cases in which the pendulum conveyor under the effect of the oscillating motion rises from the receiving conveyor at the end of the pendulum swing, without departing from the principles of the present invention.

The reversing of the conveyors can be accomplished in many different ways, which are easily constructed and adapted to the circumstances by a person skilled in the art.

I claim:

1. A method for making a mineral wool web, comprising:

(a) providing a receiving conveyor having a generally horizontal, upwardly presented carrying run which advances longitudinally in a given direction;

(b) providing a pendulum-type conveyor arrangement which includes two generally vertically arranged endless conveyor belts which are disposed laterally adjacent one another, relative to said given direction, above said carrying run of said receiving conveyor, with respective carrying runs disposed in spaced, confronting relation, with the endless conveyor belts respectively entrained about respective upper and lower rollers rotating in respective directions to cause said spaced, confronting carrying runs of said endless conveyor belts to advance downwardly towards said carrying run of said receiving conveyor, whereby said pendulum-type conveyor has a carrying gap with an upper inlet end and a lower outlet end;

(c) while oscillating said pendulum-type conveyor assembly transversally of said given direction so as to reversingly sweep said outlet end of said carrying gap from adjacent one side edge of said carrying run of said receiving conveyor, to adjacent an opposite side edge of said carrying run of said receiving conveyor, continuously feeding a primary web of uncured mineral wool into said inlet end of said carrying gap between said carrying runs of said endless conveyor belts of said pendulum-type conveyor arrangement, whereby said primary web is fed downwards by said carrying runs of endless conveyor belts and out onto said carrying run of said receiving conveyor so as to progressively provide on said carrying run of said receiving conveyor a multiple layer web of successively laid zig-zag folds of said primary webs of uncured mineral wool advancing in said given direction;

(d) During substantially all of each half cycle of oscillation of said pendulum-type conveyor assembly, in which a respective one of said endless conveyor belt leads and a respective other said endless conveyor belt trails said carrying gap, causing the respective said trailing endless conveyor belt to have said lower roller thereof disposed closer to, yet spaced above, said carrying run of said receiving conveyor than is said lower roller of the respective said leading endless conveyor belt.

2. The method of claim 1, wherein:

as each half cycle is completed, a respective endless conveyor belt which is to become the leading endless conveyor belt for the respectively next half cycle is raised and the respective endless conveyor belt which is to become the trailing endless conveyor belt for said respectively next half cycle is correspondingly lowered.

3. The method of claim 1, wherein:

during each half cycle, the respective said trailing endless conveyor belt is first progressively lowered throughout a quarter cycle, and then progressively raised throughout a quarter cycle.

4. The method of claim 3, wherein:

in step (c), the pendulum-type conveyor assembly is oscillated by a mechanical oscillating device which also connects with and thereby provides said progressive lowering and raising of the respective said trailing endless conveyor belt.

5. Apparatus for making a mineral wool web, comprising:

(a) a receiving conveyor having a generally horizontal, upwardly presented carrying run which advances longitudinally in a given direction;

(b) a pendulum-type conveyor arrangement which includes two generally vertically arranged endless conveyor belts which are disposed laterally adjacent one another, relative to said given direction, above said carrying run of said receiving conveyor, with respective carrying runs disposed in spaced, confronting relation, with the endless conveyor belts respectively entrained about respective upper and lower rollers rotating in respective directions to cause said spaced, confronting carrying runs of said endless conveyor belts to advance downwardly towards said carrying run of said receiving conveyor, whereby said pendulum-type conveyor has a carrying gap with an upper inlet end and a lower outlet end;

(c) means for oscillating said pendulum-type conveyor assembly transversally of said given direction so as to reversingly sweep said outlet end of said carrying gap from adjacent one side edge of said carrying run of said receiving conveyor, to adjacent an opposite side edge of said carrying run of said receiving conveyor;

(d) means for continuously feeding a primary web of uncured mineral wool into said inlet end of said carrying gap between said carrying runs of said endless conveyor belts of said pendulum-type conveyor arrangement, whereby said primary web is fed downwards by said carrying runs of endless conveyor belts and out onto said carrying run of said receiving conveyor so as to progressively provide on said carrying run of said receiving conveyor a multiple layer web of successively laid zig-zag folds of said primary webs of uncured mineral wool advancing in said given direction;

(e) means for movably supporting said endless conveyor belts so that during substantially all of each half cycle of oscillation of said pendulum-type conveyor assembly, in which a respective one of said endless conveyor belt leads and a respective other said endless conveyor belt trails said carrying gap, and for causing the respective said trailing endless conveyor belt to have said lower roller thereof disposed closer to, yet spaced above, said carrying run of said receiving conveyor than is said lower roller of the respective said leading endless conveyor belt.

6. The apparatus of claim 5, wherein:

as each half cycle is completed, a respective endless conveyor belt which is to become the leading endless conveyor belt for the respectively next half cycle is raised and the respective endless conveyor belt which is to become the trailing endless conveyor belt for said respectively next half cycle is correspondingly lowered, by said means movably supporting said endless conveyor belts.

7. The apparatus of claim 5, wherein:

during each half cycle, the respective said trailing endless conveyor belt is first progressively lowered throughout a quarter cycle, and then progressively raised throughout a quarter cycle, by said means movably supporting said endless conveyor belts.

8. The apparatus of claim 7, further including:

a mechanical oscillating device which oscillates said pendulum-type conveyor assembly and which also connects with and thereby provides said progressive lowering and raising of the respective said trailing endless conveyor belt.

* * * * *